US005751182A

United States Patent [19]

Thiel, IV

[11] Patent Number: 5,751,182

[45] Date of Patent: May 12, 1998

[54] RAPID START-UP CIRCUIT FOR VOLTAGE REFERENCE AND METHOD OF OPERATION

[75] Inventor: Frank L. Thiel, IV, Austin, Tex.

[73] Assignee: Texas Instruments Incorporated, Dallas, Tex.

[21] Appl. No.: 704,837

[22] Filed: Aug. 28, 1996

[51] Int. Cl.[6] ..... G05F 1/10

[52] U.S. Cl. ..... 327/539; 327/142; 327/538

[58] Field of Search ..... 323/313, 315; 327/142, 143, 376, 538, 539, 540, 541, 542, 543, 545

[56] References Cited

U.S. PATENT DOCUMENTS 5,488,329 1/1996 Ridgers ..... 327/539

*Primary Examiner*—Margaret Rose Wambach

*Assistant Examiner*—Jeffrey Zweizig

*Attorney, Agent, or Firm*—W. James Brady, III; Richard L. Donaldson

[57] ABSTRACT

A rapid start-up voltage reference (8) is provided. The rapid start-up voltage reference (8) includes a voltage reference circuit (10) operable responsive to a shut-down signal $\overline{\text{ENABLE}}$. The shut-down signal has an enable state and a disable state. The voltage reference circuit (10) has a feedback loop (12) which has a first node (NODE 1). The voltage reference circuit (10) is operable to produce an output reference voltage ($V_{REF}$) when the shut-down signal is in the enable state. A rapid start-up circuit (14) is coupled to the first node (NODE 1) and to a power supply node ($V_{cc}$). The rapid start-up circuit (14) includes a capacitor (16) and is operable responsive to the shut-down signal to charge the capacitor (16) when the shut-down signal is in the disable state and to connect the capacitor (16) to the first node (NODE 1) when the shut-down signal is in the enable state.

19 Claims, 1 Drawing Sheet

RAPID START-UP CIRCUIT FOR VOLTAGE REFERENCE AND METHOD OF OPERATION

TECHNICAL FIELD OF THE INVENTION

This invention relates in general to the field of electronic circuits, and more particularly to a rapid start-up circuit for a voltage reference and a method of operation.

BACKGROUND OF THE INVENTION

In conventional communication and computer systems, it is often desirable to disable portions of the system when those portions are not in use. One reason for disabling portions of the system is to conserve power. For example, a hard disk in a notebook computer can be disabled when the hard disk is not being accessed. It is important for disabled portions of a system to rapidly wake up and begin operating when they are again needed to perform a function.

One approach to disabling and enabling portions of a system is to have the portion or subsystem powered by a voltage reference that can be disabled by the main system. In this manner, all circuitry running from the voltage reference can be disabled along with the reference. However, conventional voltage references can be slow in responding to wake-up or enable signals. This is especially true with respect to modern low power voltage reference designs where the lower currents translate into slower response.

It is desirable to have a voltage reference that can be disabled, but that will become active and stable quickly after receiving an enable signal. For example, many communication systems require a fast start-up response to achieve the precision timing needed while maintaining maximum power efficiency.

Conventional solutions to the start-up problem have used a DC bias scheme to supply current responsive to the reference not being in its desired DC stable state. However, such DC bias schemes only allow the reference to start at its own loop speed, which may be quite slow in the case of a low power circuit. Other conventional solutions use a capacitor connected to the power supply that causes a node to respond to the ramping of the power supply to start the voltage reference. However, where an enable signal is used to enable and disable the voltage reference, such a method is not helpful because the power supply is not ramped.

SUMMARY OF THE INVENTION

Therefore a need has arisen for a rapid start-up circuit for a voltage reference and a method of operation that will quickly enable the voltage reference into operation from a disabled state.

In accordance with the present invention, a rapid start-up circuit for a voltage reference and a method of operation are provided that substantially eliminate or reduce disadvantages and problems associated with previously developed voltage references.

According to one embodiment of the present invention, a rapid start-up voltage reference is provided. The rapid start-up voltage reference includes a voltage reference circuit operable responsive to a is shut-down signal. The shut-down signal has an enable state and a disable state. The voltage reference circuit has a feedback loop which has a first node. The voltage reference circuit is operable to produce an output reference voltage when the shut-down signal is in the enable state. A rapid start-up circuit is coupled to the first node and to a power supply node. The rapid start-up circuit includes a capacitor and is operable responsive to the shut-down signal to charge the capacitor when the shut-down signal is in the disable state and to connect the capacitor to the first node when the shut-down signal is in the enable state.

According to another embodiment of the present invention, a method of rapidly starting a voltage reference circuit is provided. A capacitor is connected to a voltage source to charge the capacitor to a voltage level when the voltage reference circuit is disabled. The capacitor is disconnected from the voltage source and connected to a node in a feedback loop of the voltage reference circuit when the voltage reference circuit is enabled.

BRIEF DESCRIPTION OF THE DRAWINGS

A more complete understanding of the present invention and advantages thereof may be acquired by referring to the following description taken in conjunction with the accompanying drawings in which like reference numbers indicate like features, and wherein.

DETAILED DESCRIPTION OF THE INVENTION

Figure 1:
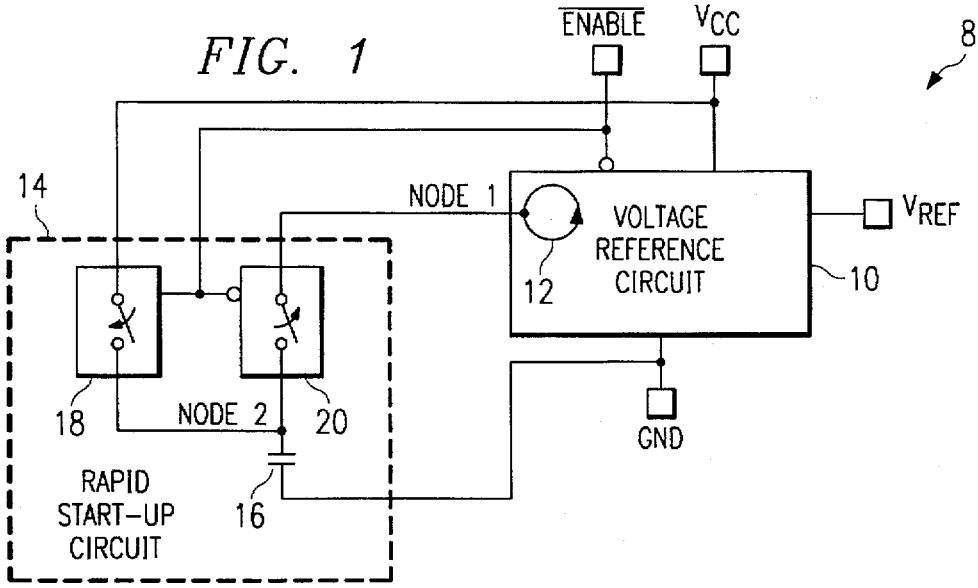
FIG. 1 is a block diagram of a rapid start-up voltage reference circuit constructed according to the teachings of the present invention.

FIG. 1 is a block diagram of a rapid start-up voltage reference circuit, indicated generally at 8, constructed according to the teachings of the present invention. Circuit 8 comprises a voltage reference circuit 10 which operates to provide a voltage reference $V_{REF}$. Voltage reference circuit 10 is coupled to a ground node GND and a power supply node $V_{cc}$ and receives a shut-down signal $\overline{\text{ENABLE}}$. Voltage reference circuit 10 can comprise a band gap voltage reference constructed in an integrated circuit. In one embodiment of the present invention, voltage reference circuit 10 comprises a band gap voltage reference constructed in a BiCMOS or CMOS process.

Voltage reference circuit 10 is operable to produce an output voltage $V_{REF}$ responsive to the shut-down signal. The shut-down signal has an enable state and a disable state. In the illustrated embodiment of the present invention, the enable state corresponds to a logic low voltage level, and the disable state corresponds to a logic high voltage level.

Voltage reference circuit 10 includes a feedback loop 12 having a first node NODE 1. Feedback loop 12 comprises feedback loop in voltage reference circuit 10 that allows voltage reference circuit 10 to produce a stable output reference voltage $V_{REF}$. A rapid start-up circuit 14 is coupled to NODE 1, power supply node $V_{cc}$, and ground node GND and receives the shut-down signal. NODE 1 is selected in feedback loop 12 such that NODE 1 has the correct polarity to respond to rapid start-up circuit 14.

Rapid start-up circuit 14 comprises a capacitor 16 coupled between a second node NODE 2 and ground node GND. A first switch 18 is coupled between positive power supply node $V_{cc}$ and NODE 2. First switch 18 receives the shut-down signal, as shown. First switch 18 has a closed state and an open state and is responsive to the shut-down signal. When the shut-down signal is in the disable state, first switch 18 is closed. When the shut-down signal is in the enable state, first switch 18 is open.

Rapid start-up circuit 14 further comprises a second switch 20 coupled between NODE 1 and NODE 2. Second switch 20 receives the shut-down signal, as shown. Second switch 20 has an open state and a closed state responsive to the shut-down signal. When the shut-down signal is in the enable state, second switch 20 is closed. Conversely, when the shut-down signal is in the disable state, second switch 20 is open.

Rapid start-up circuit 14 operates responsive to the shut-down signal $\overline{\text{ENABLE}}$ such that capacitor 16 is pre-charged to hold a voltage substantially equal to the positive power supply $V_{cc}$ when voltage reference circuit 10 is disabled. In this manner, capacitor 16 is charged during the period that the shut-down signal is in the disable state. When voltage reference circuit 10 is enabled, rapid start-up circuit 14 operates to insert capacitor 16 into feedback loop 12 such that the charge on capacitor 16 is forced into NODE 1 of feedback loop 12. This insertion of charge from capacitor 16 injects charge into feedback loop 12 making voltage reference circuit 10 quickly become enabled and produce a stable output voltage $V_{REF}$.

Specifically, in the illustrated embodiment, first switch 18 connects capacitor 16 to positive power supply node $V_{cc}$ during the period of time voltage reference circuit 10 is disabled. When the shut-down signal changes from the disable state to the enable state, first switch 18 opens, and second switch 20 closes. This disconnects capacitor 16 from power supply node $V_{cc}$ and connects capacitor 16 to NODE 1 in feedback loop 12.

NODE 1 is selected such that the change in voltage forced by capacitor 16 causes a quick start to the operation of feedback loop 12. In one embodiment of the present invention, capacitor 16 is pre-charged to a voltage level higher than its steady state voltage level after insertion into feedback loop 12. Thus, in that embodiment, NODE 1 is selected to provide positive feedback such that charge injected by capacitor 16 causes voltage reference circuit 10 to quickly move to the correct steady state output reference voltage $V_{REF}$.

A technical advantage of the present invention is the provision of a rapid start-up circuit implemented in a BiCMOS or CMOS process to quickly start a band gap voltage reference. In one embodiment of the present invention, this rapid start-up is realized in around 120 micro seconds or less.

Another technical advantage of the present invention is the provision of a low power voltage reference that has a rapid start-up circuit which will quickly switch the voltage reference circuit into operation and then remove itself from the operation of the voltage reference. This rapid start-up circuit is responsive to the shut-down signal used to control the voltage reference circuit.

A further technical advantage of the present invention is the achievement of stable start-up times that are several orders of magnitude faster than conventional solutions and doing so without a requirement for additional power to operate.

The present invention uses the concept of storing energy used to quickly start a voltage reference circuit in a capacitor while the voltage reference is disabled. Because charge stored on a capacitor is potential energy when stored, the stored energy on the capacitor does not effect the power efficiency of the circuit. However, when the shut-down signal is changed to the enable state, is the stored energy in the capacitor is transferred to the feedback loop in the voltage reference circuit achieving start-up times several orders of magnitude faster than some conventional systems.

Figure 2:
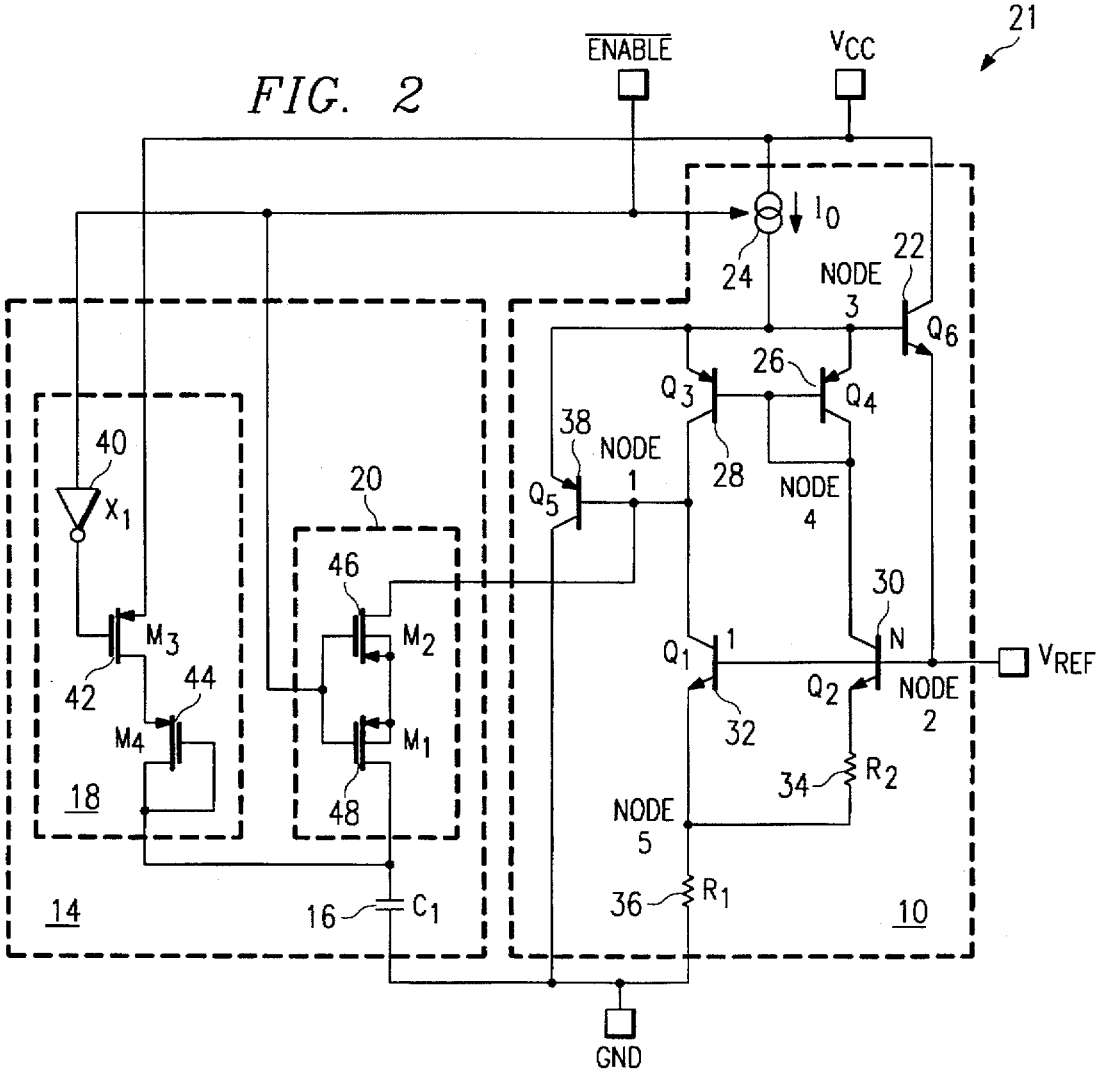
FIG. 2 is a circuit diagram of one embodiment of a rapid start-up voltage reference circuit constructed according to the teachings of the present invention.

FIG. 2 illustrates a circuit diagram of one embodiment of a rapid start-up voltage reference circuit, indicated generally at 21, constructed according to the teachings of the present invention. As shown, circuit 21 comprises a voltage reference circuit 10 and a rapid start-up circuit 14, as described above. Voltage reference circuit 10 and rapid start-up circuit 14 are coupled to a positive power supply node $V_{cc}$ and a ground node GND and receive a shut-down signal $\overline{\text{ENABLE}}$. Voltage reference circuit 10 comprises a first NPN bipolar transistor 22. Transistor 22 has a collector connected to power supply node $V_{cc}$, an emitter connected to a second node NODE 2, and a base connected to a third node NODE 3. A current source 24 is connected between power supply node $V_{cc}$ and NODE 3, as shown. Current source 24 operates to provide a current $I_o$ responsive to the shut-down signal. Current source 24 is turned on when the shut-down signal is in the enable state and is turned off when the shut-down signal is in the disabled state. In the illustrative embodiment, the shut-down signal is in the enable state when it is a logic low voltage, and is in the disabled state when it is a logic high voltage.

Voltage reference circuit 10 further comprises a first PNP bipolar transistor 26, and a second PNP bipolar transistor 28. Transistor 26 has an emitter connected to NODE 3, a collector connected to NODE 4, and a base connected to NODE 4. Transistor 28 has an emitter connected to NODE 3, a base connected to NODE 4, and a collector connected to NODE 1. A second NPN bipolar transistor 30 and a third NPN bipolar transistor 32 are scaled with an emitter area ratio N:1. Transistor 30 has a collector connected to NODE 4, a base connected to NODE 2, and an emitter connected to a resistor 34. Transistor 32 has a collector connected to NODE 1, a base connected to NODE 2, and an emitter connected to NODE 5. Resistor 34 is connected between the emitter of transistor 30 and NODE 5. A second resistor 36 is connected between NODE 5 and ground node GND. A third PNP bipolar transistor 38 has an emitter connected to NODE 3, a base connected to NODE 1, and a collector connected to ground node GND.

Voltage reference circuit 10 operates to provide a stable band gap voltage reference $V_{REF}$ when enabled by the shut-down signal. Rapid start-up circuit 14 is connected to NODE 1 in order to inject charge from capacitor 16 into NODE 1 at the point when voltage reference circuit 10 is enabled.

Rapid start-up circuit 14 comprises a first switch 18 and a second switch 20. First switch 18 comprises an inverter 40 which operates to invert the shut-down signal. A P-channel MOSFET 42 has a source connected to power supply node $V_{cc}$, a gate connected to inverter 40, and a drain, as shown. The drain of PMOS 42 is connected to a source of a second P-channel MOSFET 44. PMOS 44 has a gate and drain connected to capacitor 16.

Second switch 20 has a first P channel MOSFET 46, and a second P-channel MOSFET 48. PMOS 46 and PMOS 48 are arranged in a back to back structure as shown. In the illustrative embodiment, PMOS 46 and PMOS 48 comprise enhancement/depletion transistors which have a near zero volt threshold voltage.

When voltage reference circuit 10 is enabled and in its stable state, transistor 38 operates to divert current so that only enough current enters the remaining devices of voltage reference circuit 10 to maintain the stable output reference voltage $V_{REF}$. In this manner, voltage reference circuit 10 is a low current stable voltage reference. When voltage reference circuit 10 is first enabled, the insertion of pre-charged capacitor 16 operates initially to turn off transistor 38. This causes a large amount of current to be forced into the remaining portions of voltage reference circuit 10. Both the charge from capacitor 16 and the current produced by current source 24 circuit is forced through voltage reference circuit 10. Voltage reference circuit 10 then quickly settles into its stable output reference voltage.

Resistor 34, resistor 36, and transistors 22, 26, 28, 30, 32 and 38 form a silicon band gap voltage reference. PMOS transistors 42, 44, 46 and 48, as well as inverter 40 and capacitor 16 form the rapid start-up circuit. When the shut-down signal is high (disabled state), voltage reference circuit 10 is disabled. Thus, current source 24 is off, and therefore the output voltage $V_{REF}$ is at ground potential. In this mode, PMOS transistors 46 and 48 are off, and PMOS transistor 42 is switched on due to inverter 40. Thus, capacitor 16 is disconnected from NODE 1 and is connected to positive power supply node $V_{cc}$. This acts to pre-charge capacitor 16 to the highest available voltage on the integrated circuit rather than setting capacitor 16 to ground potential which it would be set to were it left connected to NODE 1.

It should be noted that PMOS transistors 46 and 48 are low threshold voltage PMOS devices in order to give a maximum available gate to source voltage less threshold voltage when these devices are switched on. However, these devices can go slightly depletion mode over process and temperature variation. Thus, PMOS transistor 44 is inserted in order to block any conduction from the power supply when PMOS transistors 46 and 48 are switched off. Additionally, PMOS transistors 46 and 48 are connected with their backgates shorted together to prevent conduction when the top plate of capacitor 16 is pulled to the positive power supply $V_{cc}$. When the shut-down signal $\overline{\text{ENABLE}}$ goes to the enable state, enabling voltage reference circuit 10, capacitor 16 is inserted into the feedback loop at NODE 1. At this point, capacitor 16 is precharged to the power supply voltage. Capacitor 16 forces charge into the feedback loop which snaps the feedback loop into operation. Capacitor 16 is then automatically settled to the correct DC operating point by the closed loop response of the voltage reference circuit 10. When the shut-down signal is in the enabled state, PMOS transistors 46 and 48 are on, while inverter 40 inverts the shut-down signal to switch PMOS transistor 42 off. Capacitor 16 turns transistor 38 off at the moment of insertion into NODE 1. This allows all of the current $I_o$ generated by current source 24 to be gained by transistor 22 to rapidly pull the entire loop into operation.

Although not required, a secondary start-up DC bias circuit could be used to keep voltage reference $V_{REF}$ from being impulsed out of regulation by its load when there was no enable switch. Further, care can be taken in sizing transistors 46 and 48 to keep the series resistance with capacitor 16 to a minimum. The series resistance can alter the closed loop response of the voltage reference 10.

Although the present invention has been described in detail, it should be understood that various changes, substitutions and alterations can be made hereto without departing from the spirit and scope of the invention as defined by the appended claims.

What is claimed is:

1. A rapid start-up voltage reference, comprising:

a voltage reference circuit operable responsive to a shut-down signal, the shut-down signal having an enable state and a disable state, and the voltage reference circuit comprising a feedback loop having a first node and operable to produce an output reference voltage when the shut-down signal is in the enable state; and a rapid start-up circuit coupled to a power supply node and to the first node, the rapid start-up circuit comprising a capacitor and operable responsive to the shut-down signal to charge the capacitor when the shut-down signal is in the disable state and to connect the capacitor to the first node when the shut-down signal is in the enable state.

2. The rapid start-up voltage reference of claim 1, wherein the power supply node comprises a connection for a positive power supply.

3. The rapid start-up voltage reference of claim 1, wherein the power supply node comprises a connection for a negative power supply.

4. The rapid start-up voltage reference of claim 1, wherein the voltage reference circuit comprises a silicon band gap voltage reference.

5. The rapid start-up voltage reference of claim 1, wherein the voltage reference circuit and the rapid start-up circuit are constructed in an integrated circuit on a semiconductor chip.

6. The rapid start-up voltage reference of claim 1, wherein the rapid start-up circuit comprises:

a capacitor coupled between a second node and a ground potential node;

a first switch, having an open state and a closed state, coupled between a positive power supply node and the second node, the first switch receiving the shut-down signal and operable to be in the closed state when the shut-down signal is in the disabled state and in the open state when the shut-down signal is in the enabled state; and a second switch, having an open state and a closed state, coupled between the first node and the second node, the second switch receiving the shut-down signal and operable to be in the closed state when the shut-down signal is in the enabled state and in the open state when the shut-down signal is in the disabled state.

7. The rapid start-up voltage reference of claim 1, wherein the rapid start-up circuit comprises:

a capacitor coupled between a second node and a ground potential node;

a first switch, having an open state and a closed state, coupled between a negative power supply node and the second node, the first switch receiving the shut-down signal and operable to be in the closed state when the shut-down signal is in the disabled state and in the open state when the shut-down signal is in the enabled state; and a second switch, having an open state and a closed state, coupled between the first node and the second node, the second switch receiving the shut-down signal and operable to be in the closed state when the shut-down signal is in the enabled state and in the open state when the shut-down signal is in the disabled state.

8. The rapid start-up voltage reference of claim 1, wherein the rapid start-up circuit comprises:

a capacitor coupled between a second node and a ground potential node;

a first switch, having an open state and a closed state, coupled between a positive power supply node and the second node, the first switch comprising:

a PMOS transistor having a source coupled to the positive power supply, a drain coupled to the second node, and a gate coupled to the shut-down signal;

such that the first switch is operable to be in the closed state when the shut-down signal is in the disabled state and in the open state when the shut-down signal is in the enabled state; and a second switch, having an open state and a closed state, coupled between the first node and the second node, the second switch receiving the shut-down signal and operable to be in the closed state when the shut-down signal is in the enabled state and in the open state when the shut-down signal is in the disabled state.

9. The rapid start-up voltage reference of claim 1, wherein the rapid start-up circuit comprises:

a capacitor coupled between a second node and a ground potential node;

a first switch, having an open state and a closed state, coupled between a positive power supply node and the second node, the first switch receiving the shut-down signal and operable to be in the closed state when the shut-down signal is in the disabled state and in the open state when the shut-down signal is in the enabled state; and a second switch, having an open state and a closed state, coupled between the first node and the second node, the second switch comprising:

a pair of back to back PMOS transistor having sources coupled together, a drain of one transistor coupled to the first node and a drain of the other transistor coupled to the second node, and both gates coupled to the shut-down signal;

such that the second switch is operable to be in the closed state when the shut-down signal is in the enabled state and in the open state when the shut-down signal is in the disabled state.

10. A rapid start-up voltage reference, comprising:

a voltage reference circuit operable responsive to a shut-down signal, the shut-down signal having an enable state and a disable state, and the voltage reference circuit comprising a feedback loop having a first node and operable to produce an output reference voltage when the shut-down signal is in the enable state; and a rapid start-up circuit comprising;

a capacitor coupled between a second node and a ground potential node;

a first switch, comprising;

an inverter connected to the shut-down signal;

a first PMOS transistor having a gate connected to the inverter, a source connected to the power supply node, and a drain; and a second PMOS transistor having a source connected to the drain of the first PMOS transistor, and a gate and a drain connected to the second node; and a second switch, comprising;

a third PMOS transistor having a drain connected to the first node, a gate connected to the shut-down signal, a source, and a backgate connected to the source; and a fourth PMOS transistor having a drain connected to the second node, a gate connected to the shut-down signal, and a source and a backgate connected to the source of the third PMOS transistor;

such that the rapid start-up circuit is operable responsive to the shut-down signal to charge the capacitor when the shut-down signal is in the disable state and to connect the capacitor to the first node when the shut-down signal is in the enable state.

11. The rapid start-up voltage reference of claim 10, wherein the voltage reference circuit comprises a silicon band gap voltage reference.

12. The rapid start-up voltage reference of claim 10, wherein the voltage reference circuit and the rapid start-up circuit are constructed in an integrated circuit on a semiconductor chip.

13. A method of rapidly starting a voltage reference circuit, comprising:

connecting a capacitor to a voltage source to charge the capacitor to a voltage level when the voltage reference circuit is disabled; and disconnecting the capacitor from the voltage source and connecting the capacitor to a node in a feedback loop of the voltage reference circuit when the voltage reference circuit is enabled.

14. The method of claim 13, wherein the step of connecting comprises closing a first switch coupled between the capacitor and a voltage source and opening a second switch coupled between the capacitor and the node in the feedback loop.

15. The method of claim 13, wherein the step of disconnecting comprises opening a first switch coupled between the capacitor and a voltage source and closing a second switch coupled between the capacitor and the node in the feedback loop.

16. The method of claim 13, wherein the steps of connecting and disconnecting are controlled by a shut-down signal for the voltage reference circuit.

17. The method of claim 13, wherein the steps of connecting and disconnecting comprise connecting the capacitor to a positive power supply.

18. The method of claim 13, wherein the steps of connecting and disconnecting comprise connecting the capacitor to a negative power supply.

19. The method of claim 13, wherein the steps of connecting and disconnecting are accomplished by a rapid start-up circuit in an integrated circuit on a semiconductor chip.

* * * * *

UNITED STATES PATENT AND TRADEMARK OFFICE

CERTIFICATE OF CORRECTION

PATENT NO. : 5,751,182
DATED : 05/12/98
INVENTOR(S) : Frank L. Thiel, V

It is certified that error appears in the above-indentified patent and that said Letters Patent is hereby corrected as shown below:

On the title page, item [75]

The correct name is: Frank L. Thiel, V

Signed and Sealed this

Seventeenth Day of November, 1998

*Attest:*

*Attesting Officer*

BRUCE LEHMAN

*Commissioner of Patents and Trademarks*